US012115431B2

(12) United States Patent
Hackney

(10) Patent No.: US 12,115,431 B2
(45) Date of Patent: Oct. 15, 2024

(54) TRAINING DEVICES AND METHODS

(71) Applicant: Missouri State University, Springfield, MO (US)

(72) Inventor: James Hackney, Springfield, MO (US)

(73) Assignee: MISSOURI STATE UNIVERSITY, Springfield, MO (US)

( * ) Notice: Subject to any disclaimer, the term of this patent is extended or adjusted under 35 U.S.C. 154(b) by 597 days.

(21) Appl. No.: 17/168,867

(22) Filed: Feb. 5, 2021

(65) Prior Publication Data

US 2021/0245030 A1 Aug. 12, 2021

Related U.S. Application Data

(60) Provisional application No. 62/971,505, filed on Feb. 7, 2020.

(51) Int. Cl.

| | |
|---|---|
| ***A63B 71/06*** | (2006.01) |
| ***A63B 21/00*** | (2006.01) |
| ***A63B 21/04*** | (2006.01) |
| ***A63B 21/055*** | (2006.01) |

(52) U.S. Cl.

CPC ..... *A63B 71/0619* (2013.01); *A63B 21/0428* (2013.01); *A63B 21/0552* (2013.01); *A63B 21/4005* (2015.10); *A63B 21/4015* (2015.10); *A63B 2214/00* (2020.08)

(58) Field of Classification Search

CPC ..... A63B 21/4005; A63B 21/4015; A63B 2214/00; A63B 71/0619; A61H 3/00

See application file for complete search history.

(56) References Cited

U.S. PATENT DOCUMENTS 10,974,120 B2 * 4/2021 Christopherson .. A63B 69/3667

OTHER PUBLICATIONS https://web.archive.org/web/20170404074750/https:/www.theraband.com/products/rehab-therapy/theraband-wellness-station-accessories-padded-bar-with-two-d-ring-connectors-3-feet.html (accessed on May 26, 2021).

https://www.buyfitnation.com/collections/shop-all/products/fitnation-total-body-exercise-bar; accessed on Apr. 28, 2021.

Screen capture from YouTube video clip entitled "FITNATION Total Body Exercise Bar With Echelon Experience App on QVC" 1 Page, uploaded on Jun. 9, 2018; Retrieved from Internet: https://www.youtube.com/watch?v=ufFn3Pv_6rY.

* cited by examiner

*Primary Examiner* — Timothy A Musselman

(74) *Attorney, Agent, or Firm* — Kutak Rock LLP; Brian L. Main

(57) ABSTRACT

A training device and methods of using the device are described to train athletes to reduce the incidence of certain types of injuries. The device and methods promote a reduction in knee vulgus and hip internal rotation during typical athletic movements such as jumping, landing, and lateral bounding. The device provides a guide element that serves as a reference line providing feedback to a user on their movements. A user may adjust their joint positions during the movements based upon self-monitoring or feedback from a trainer who observes the user executing movements while wearing the device. The guide element may provide feedback on knee positioning in two axes of movement.

20 Claims, 6 Drawing Sheets

TRAINING DEVICES AND METHODS

CROSS-REFERENCE TO RELATED APPLICATIONS

This application claims the benefit of U.S. Provisional Patent Application Ser. No. 62/971,505 filed Feb. 7, 2020, the disclosure of which is incorporated herein by reference.

BACKGROUND

Field of the Invention

This disclosure is in the field of training devices and methods for physical training to minimize pain or injuries arising from athletic activities. More specifically, this disclosure is in the field of devices and methods for training subjects to minimize kinematic moments associated with knee pain and injuries. More specifically, this disclosure is in the field of devices and methods for training subjects to reduce knee vulgus during jumping, landing, and cutting movements.

SUMMARY OF THE INVENTION

In various embodiments, the invention is a method of using a training device having a left guide element and a right guide element to train a subject, the method comprising the steps of adjusting the training device for the subject; receiving feedback from the training device during a movement performed by the subject; wherein the step of receiving feedback from the training device comprises the step of: determining if a lateral aspect of a left knee or a right knee of the subject maintained contact with the left guide element or the right guide element, respectively, during the movement.

In some versions the method comprises the steps of positioning the left guide element so that it extends from substantially at the subject's left shoulder to substantially at the subject's left toes; and positioning the right guide element so that it extends from substantially at the subject's right shoulder to substantially at the subject's right toes.

The step of receiving feedback from the training device may comprise the steps of determining if a left knee or a right knee of the subject extended in front of the left guide element or the right guide element, respectively, during the movement. The movement may be selected from the group consisting of a two-footed jump and a lateral bound. The method may further comprise the step of repeating the movement to reposition a left knee or a right knee with respect to the left guide element or right guide element, respectively. The method may further comprise the step of altering the movement in response to the feedback.

The training device may comprise a shoulder member for positioning the left and right guide elements in relation to the left and right shoulders of the subject, respectively; a left foot-attachment component and a right foot-attachment component for positioning the left and right guide elements in relation to the left and right feet of the subject, respectively.

Adjusting the device may comprise adjusting the points of attachment of an upper end of the left guide element and an upper end of the right guide element to the shoulder member to position the upper ends thereof substantially at the subject's left and right shoulders, respectively.

Adjusting the device further comprises attaching a lower end of the left guide element and a lower end of the right guide element to the to the left and right foot-attachment components to position the lower ends thereof substantially at the toes of the subject's left and right foot, respectively. In some uses of the device, the left and right guide elements extend and contract during the movement to maintain a reference position running from the subject's left and right shoulders to the subject's left and right feet, respectively. In some embodiments of the device the left and right guide elements exert a minimal force that does not substantially alter the subject's performance of the movement.

A training device comprising a shoulder member for positioning the left and right guide elements in relation to the left and right shoulders of the subject, respectively; a left foot-attachment component and a right foot-attachment component for positioning the left and right guide elements in relation to the left and right feet of the subject, respectively; wherein the right and left guide elements extend from approximately the right and left shoulders of the user to approximately the right and left toes of the user, respectively.

DETAILED DESCRIPTION

Figure 1:
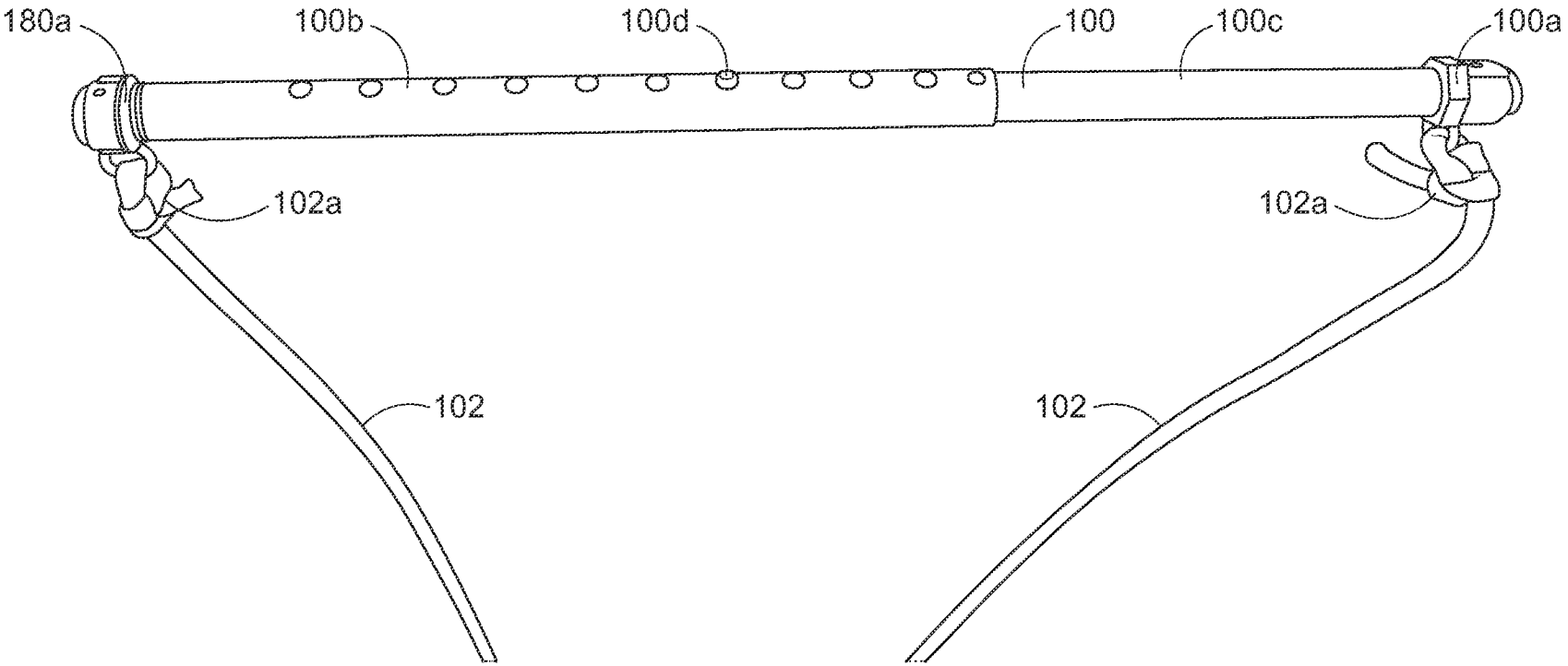
FIG. 1 is a perspective view of a portion of an embodiment of the inventive device.

Many athletic activities include jumping, landing, lateral bounding, or abrupt changes of direction, referred to as cutting, that generate substantial dynamic forces on the joints of the athletes performing these movements. If the movements are performed with certain joint alignments or certain kinematic patterns, they may result in pain or joint injury. For example, some studies have suggested that hip internal rotation, insufficient hip flexion, and dynamic knee vulgus associated with the deceleration of landing or the lateral forces of cutting are kinematic patterns associated with knee pain and injuries, such as patellofemoral pain and anterior cruciate ligament (ACL) injury.

Dynamic knee vulgus occurs when the knees adduct (displace medially) with hip adduction and hip internal rotation with insufficient hip flexion. It is characterized by the knees moving closer together as they flex causing an external rotation of the knee joint. The extent of dynamic knee vulgus may be characterized by measuring the knee vulgus moment during activities such as those described above. A reduction in the knee vulgus moment during such activities may reduce the incidence of knee pain and injuries. One of the causes of knee vulgus is excessive knee flexion or bending of the knees with insufficient hip flexion. In some embodiments, an aspect of the inventive devices and methods is designed to train a user to reduce knee flexion and increase hip flexion during certain activities.

Training devices and methods are described for use in reducing dynamic knee vulgus and related movement dynamics of a training subject. In some cases, the use of the devices and methods may cause subjects to increase muscle strength in specific muscle groups that counter the tendency toward knee vulgus. In other cases, the use of the devices and methods may cause subjects to develop better movement habits resulting from the feedback aspects of the training methods. The actual mechanism or underlying cause for the improvement is not limiting of the scope of the inventive devices and methods.

In various embodiments, the training device provides a reference or guide to the user during training. It does not use resistance or applied force to adjust the user's kinematic patterns but provides a frame of reference so that the user can modify their movements to reduce the unwanted characteristics. In some embodiments a trainer watches the subject during use of the training devices to provide feedback and guidance to improve the movements described above.

In the depicted embodiment, the training device comprises a shoulder member 100, two guide elements 102, and two foot-attachment components 104. The shoulder member 100 and the foot-attachment components 104 are utilized to position the guide elements 102 in a desired position with respect to the body of the subject using the device.

The shoulder member 102 is provided to hold an upper end of the guide elements 102 in proper position with respect to the user's body as shown in later Figures. In a preferred embodiment the shoulder member positions the upper ends of the guide elements 102, substantially at the user's shoulders or adjacent to the shoulders, at points that are approximately pelvis-width apart or slightly wider. In the depicted embodiment the two guide elements 102 are connected to fixed attachment points 100*a* on the first and second bar 101*b*, so the length of the bar 100 must be changed as necessary to separate the guide elements 102 by the user's approximate hip or pelvis width. In other embodiments the attachment points 100*a* may be moveable on the shoulder member 100 so that the overall length of the shoulder member 100 may be fixed so long as the separation between the two attachment points 100*a* is adjustable. For example, the embodiment of the device depicted in FIG. 3B utilizes movable attachment points 100*a*. The shoulder member 100 may comprise a bar as in the depicted embodiment, but in other embodiments of the device the bar may be replaced with one or two attachment devices, such as a device to attach one or both of the guide elements 102 to the users clothing, uniform, or pads (such as football shoulder pads).

In the embodiment depicted in FIG. 1, the shoulder member 100 comprises a first bar 100*b*, a second bar 100*c* slidably connected to the first bar 100*b*, and an adjustment mechanism 100*d* to allow the first bar 100*b* and the second bar 100*c* to be secured at a desired length. In the depicted embodiment the adjustment mechanism 100*d* is a spring-loaded detent attached to one bar 100*b* or 100*c* that engages apertures or other features on the other bar 100*b* or 100*c*. One of skill in the art of such devices will be able to utilize other embodiments of the shoulder member 100 that function in alternative manners to achieve the result of positioning the upper ends of the guide elements in relation to the user's shoulders.

In the depicted embodiment, the guide elements 102 comprise flexible or elastic bands that are attached at a first end 102*a* to an attachment point 100*a* on the bar 100. The guide elements 102 serve as a reference line between the user's shoulders and feet and should not exert a substantial force on the user that will materially alter the kinematics of the user's movement. As will be described in more detail, the user is instructed and monitored to keep the knees in a desired relationship to the guide elements 102 during use of the device while performing certain movements.

During use of the device, the guide elements 102 change their effective length as necessary to maintain the desired reference line, and thus some embodiments of the guide elements 102 are capable of lengthwise extension and contraction as the user moves and extends and flexes their knees and hips. In the depicted embodiment of the device the guide elements 102 are elastic bands that stretch and shorten as the user moves without exertion of substantial force. In other embodiments the guide elements 102 may be non-elastic or partially elastic wires or bands that coil and uncoil automatically from spools attached to the bar 100 or to the foot attachment devices 104. The exact mechanism or material used to provide the guide element 102 is not limiting of the scope of the claims, and other such mechanisms or materials not disclosed herein may be utilized for the guide elements 102 within the scope of the invention as described in the claims.

Figure 2:
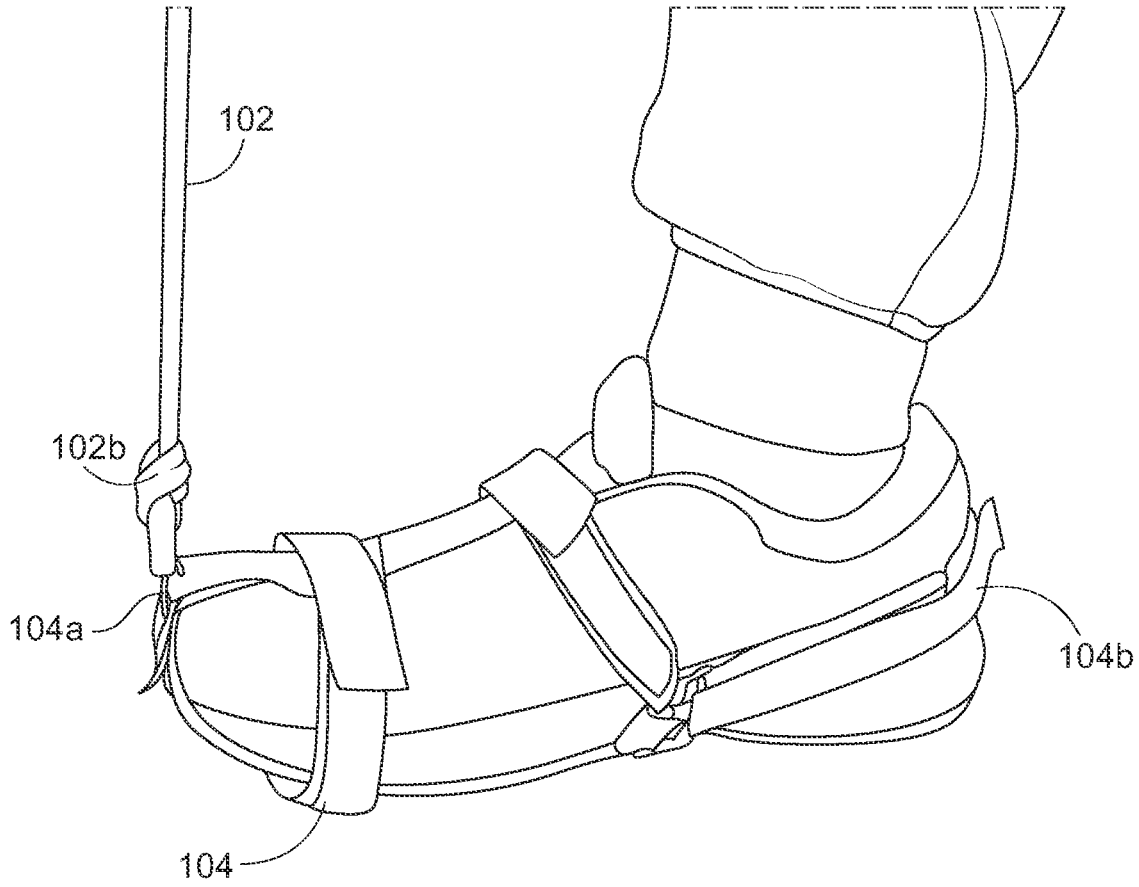
FIG. 2 is a perspective view of a portion of an embodiment of the inventive device.

The guide elements 102 also attach to a point near or approximately or substantially at the user's toes. This positioning of the lower end of the guide elements 102 establishes a preferred reference line from substantially near the user's shoulders to substantially at their toes. Referring to FIG. 2, an embodiment of the foot attachment component 104 is depicted attached to a user's foot. In this embodiment the component 104 comprises a guide attachment point 104*a* and one or more straps 104*b*. In varying embodiments the guide attachment point 104*a* may be a strap or wire loop, a metal ring, a grommet, or other such element to which the guide element 102 may be tied or connected. In other embodiments other types of connections may be utilized as will be apparent to one of skill. In the depicted embodiment, the straps 104*b* are sewn together and provided with Velcro so that they may be adjustable fastened around the arch and heel of the foot or shoe of the user. The particular configuration of straps 104*b* or even the use of straps 104*b* is not required for the invention so long as the component 104 is able to hold the guide attachment point 104*a* near the desired location substantially at, or slightly above the user's toe. In preferred embodiments of the device the guide attachment point 104*a* is near the longitudinal centerline of the foot, but in other embodiments it may be closer to the lateral or medial aspect of the foot.

Figure 3B:
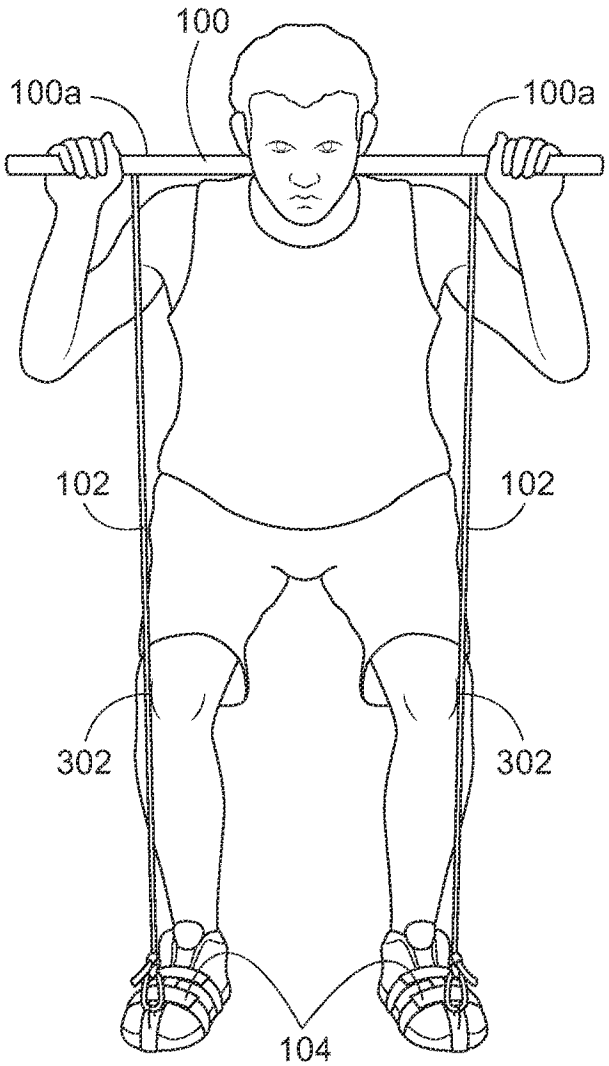
FIG. 3B is a front view of a person using an embodiment of the inventive device.
Figure 3A:
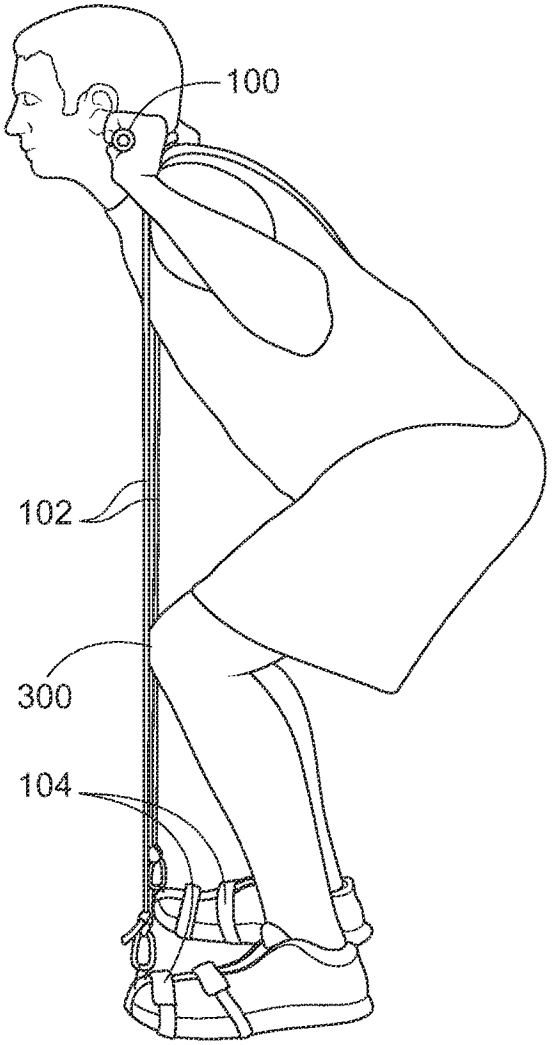
FIG. 3A is a side view of a person using an embodiment of the inventive device.
Figure 3C:
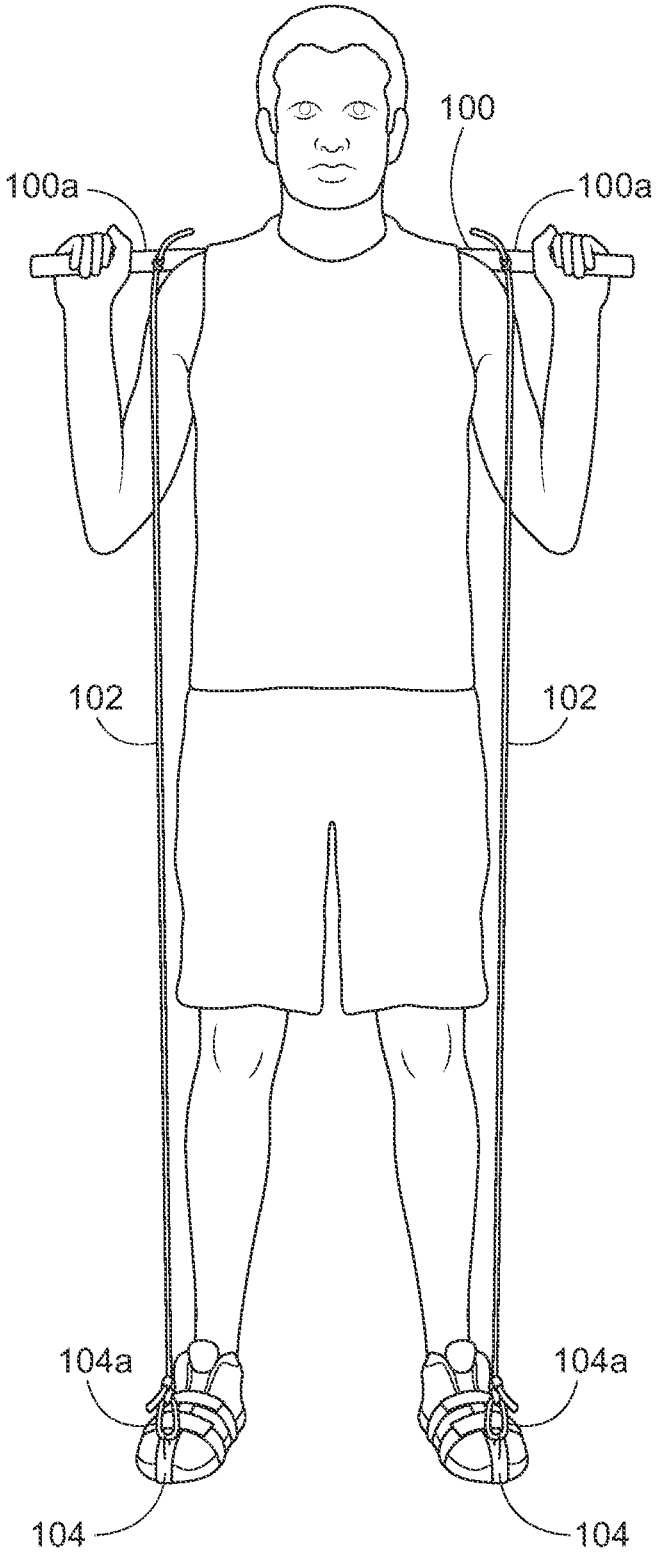
FIG. 3C is a front view of a person with an embodiment of the inventive device.

Referring now to FIGS. 3A and 3B, a side view and a front view, respectively, of a user with an embodiment of the inventive device are depicted. The attachment points 100*a* where the upper ends of guide elements 102 are attached to shoulder member 100 have been adjusted to the approximate width of the user's shoulders so that the guide elements 102 extend downwardly just outside the user's shoulders. The lower end of the guide elements 102 are attached to foot-attachment components 104 substantially above the user's toes. The guide elements 102 extend downwardly along the sides of the user's body, near to or slightly wider than the user's pelvis.

When the device has been properly adjusted for a user's body the guide elements 102 provide a two-axis reference line or the user's knee. Referring now to FIG. 3A, when squatting or landing in the training movements, the user is instructed to keep the front of the knee cap 300 substantially in line with the guide element 102. If the knee cap 300 extends in front of the guide element 102 (to the left in FIG. 3A) then the user has over-flexed the knee and under-flexed the hip. If the knee cap 300 is substantially behind the guide element 102 (to the right in FIG. 3A) then the user has over-flexed the hip and under-flexed the knee. If the knee cap 300 is in line with the guide element 102 then the preferred balance of knee and hip flexion is achieved.

Similarly, when the device has been properly adjusted for a user's body, it provides a reference line for side-to-side or lateral movement of the knee as well. Referring now to FIG. 3B, the lateral aspect 302 of the knee is substantially touching or near the guide element 102. If the later aspect 302 of the knee moves inwardly from that position and substantially separates from the guide element 102 then it reflects a knee vulgus movement. If a user keeps the lateral aspect 302 of the knee near or substantially in contact with the guide element 102 knee vulgus will be substantially prevented from occurring during the movement.

Figure 4A:
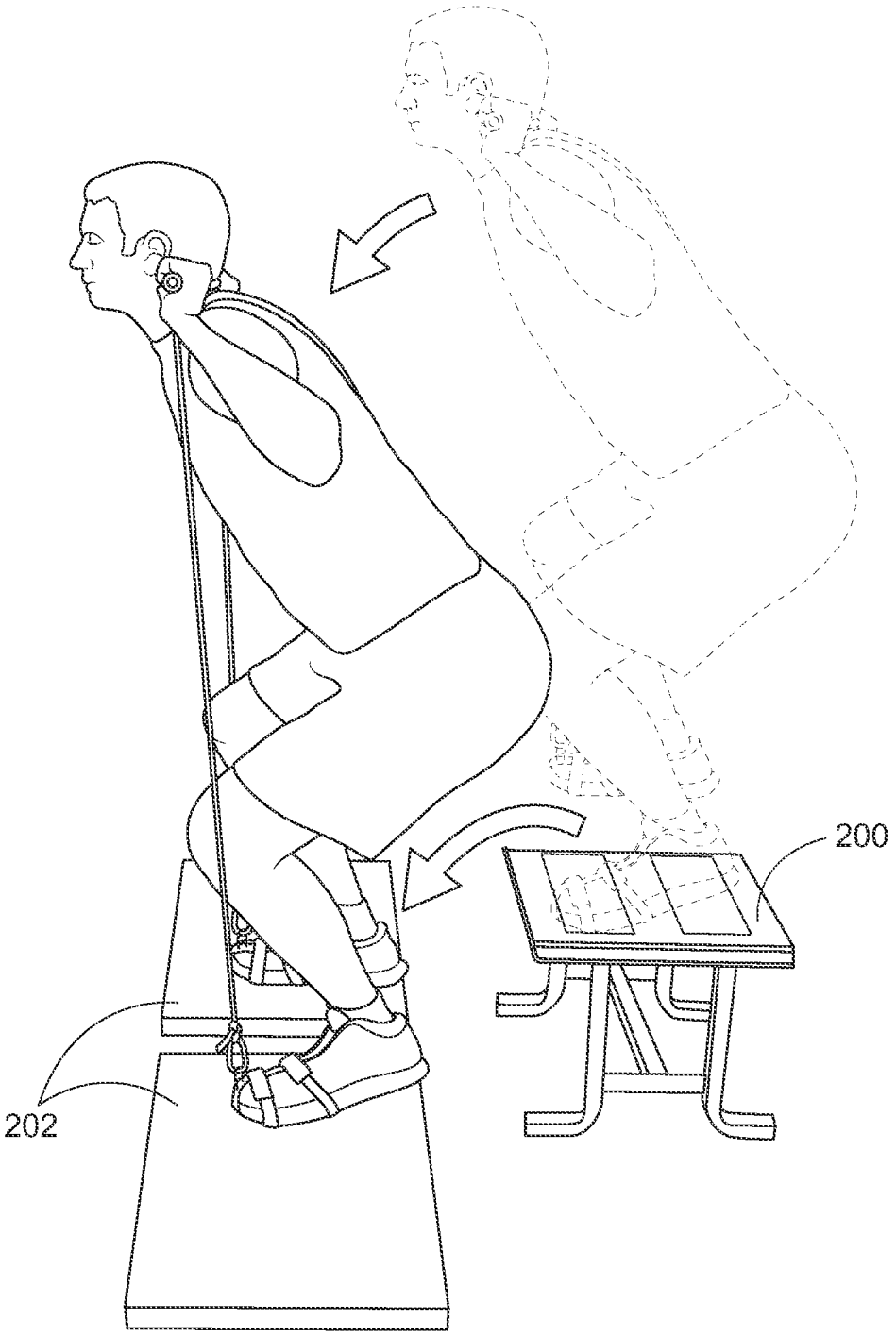
FIG. 4A is a side view of a person performing a two-footed jump exercise.

The various embodiments of the device may be used by a person as a training aid to practice improved kinematics during certain movements. In some methods of using the device, the user may perform two-footed jumping movements while wearing an embodiment of the device. An example of a two-footed jump is depicted in FIG. 4A. In this method of the two-footed jump the user begins by standing on a raised platform 200. The user jumps off the platform 200 with both feet simultaneously and lands on lower surface 202 using both feet simultaneously. During jumping and landing the knees and hips flex to generate the jumping force and to absorb the landing impact.

When using the device to provide feedback during two-footed jumping the user attempts to keep the front of the knee behind the guide element 102. During jumping and landing this movement, maintaining the front of the knee behind the reference line created by guide elements 102 between the user's shoulders and feet helps prevent over-flexion of the knee which is one cause of knee vulgus. The user is forced to increase hip flexion to compensate for any reduction in knee flexion. During the jumping and landing of the two-footed jump the user also attempts to make or maintain contact between the lateral aspect 302 of each knee and the adjacent guide element 102. This helps prevent internal rotation of the hip and knee vulgus during the movement by keeping the knees apart.

In a preferred method of using the device during a two-footed jumping movement, the user receives feedback on body position during the movement. For example, if the user has over-flexion of the knees or under-flexion of the hips, their knees will extend in front of the guide elements 102 during jumping or landing of the two-footed jump. Similarly, if the user's hips rotate internally the user's knees will lose contact with the guide elements 102 during the landing. In some methods of using the device, the user may monitor their own body positions using the device. However, in preferred methods a trainer observes the user in the process of performing multiple two-footed jumps and provides verbal or visual feedback to the user to adjust their body position.

Figure 4B:
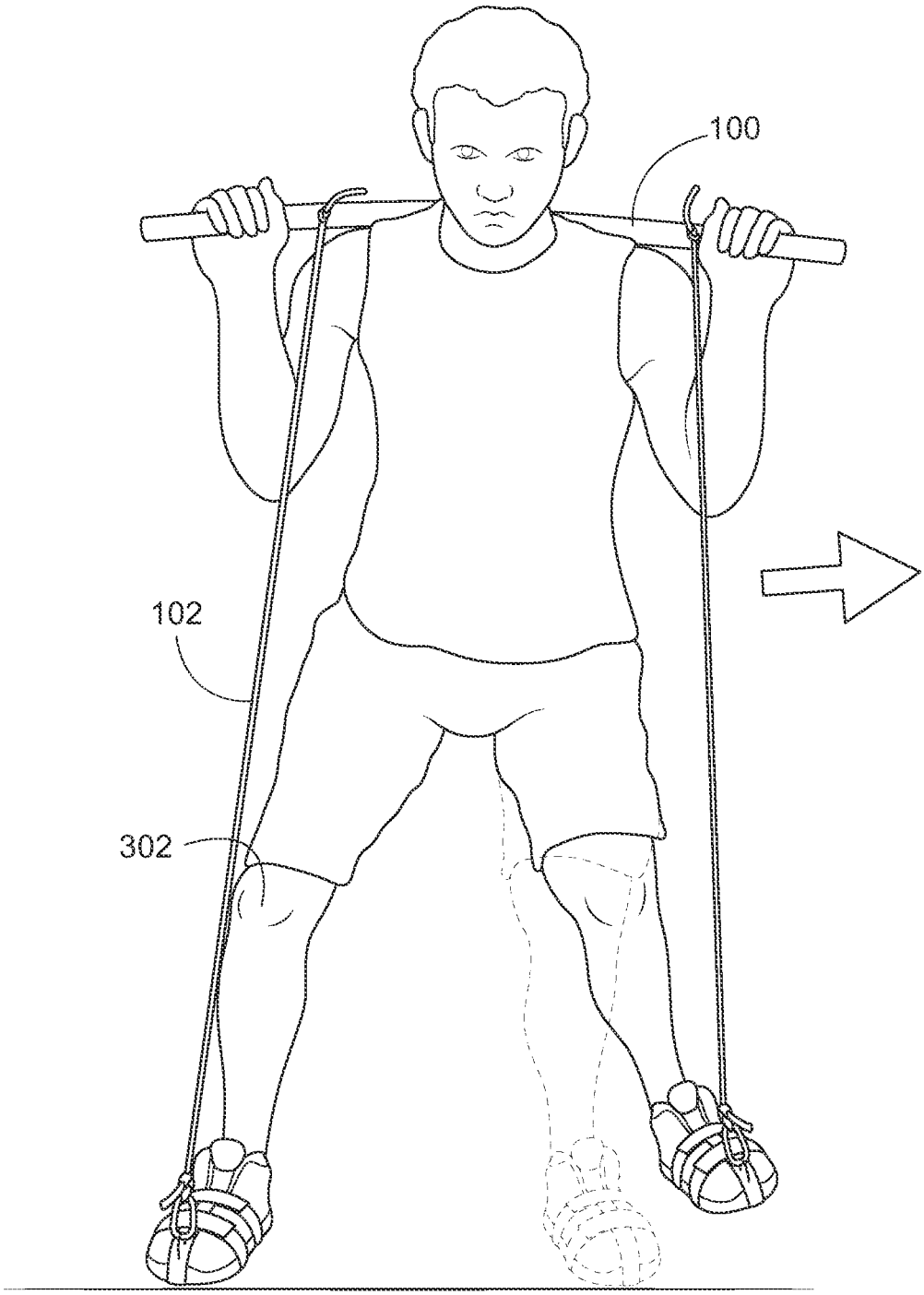
FIG. 4B is a front view of a person performing a lateral bounding exercise.

In other methods of using the device, the user may perform lateral bounding while using an embodiment of the device. An example of lateral bounding is depicted in FIG. 4B. In this movement, the user pushes off one foot while stepping out to the side and landing with the other foot. In the depiction in FIG. 4B, the user has pushed off his left foot and landed on his right foot. When landing the user attempts to keep the lateral aspect of their knee in contact with the guide element 102 to prevent internal hip rotation and knee vulgus. Similarly, during jumping the lateral aspect of the jumping foot may also be monitored to maintain it near or substantially at the guide element on that side of the user's body. During this movement the knees are preferably also kept behind the adjacent guide element 102 to prevent over flexion of the knees.

In some embodiments of methods of using the device the methods comprise the steps of: adjusting the device for the dimensions of the user's body, attaching the device to the user, repetitively performing a training movement; receiving feedback from the device during the training movement. In some methods, the step of receiving feedback comprises the user monitoring the positioning of their knees with respect to the guide elements. In some methods the step of receiving feedback comprises a trainer watching the user during the movement and providing feedback to the user.

In some embodiments of the method, the method further comprises the step of adjusting the body position in response to the feedback from the device. In some of these embodiments, adjusting the body position comprises substantially maintaining contact between the lateral aspect of the user's knees and the adjacent guide elements during the movement. In some of these embodiments, adjusting the body position comprises keeping the front of each of the user's knee caps substantially behind the adjacent guide element.

In a preferred embodiment of the method, a subject performs the movements using the device at least four times per week for a period of four weeks. In other preferred embodiments the subjects were supervised during the training sessions using the device and received feedback from the supervisor to assist in correction of the form of movements. The training sessions result in reduced maximum knee vulgus and reduced the ratio between knee and hip flexion moments during the movements.

In some embodiments of these methods, the step of adjusting the device for a user comprises configuring the device so that the guide elements 102 extend from substantially at the user's shoulders to substantially at the user's toes. In some embodiments of the method the step of adjusting the device further comprises the step of adjusting the attachment point of the guide elements to the shoulder member. In some embodiments of the method the step of adjusting the device further comprises the step of adjusting the length of the shoulder member.

Other methods of performing these movements, and other types of movements that lead to knee vulgus or other types of improper joint positioning of the hip and knee joints may be used instead of or in addition to the foregoing movements.

When used in this description "substantially", "approximately", or variants of those terms mean to be more-or-less conforming to the particular position, dimension, range, shape, concept, or other aspect modified by the term, such that a feature or component need to conform exactly to that aspect.

Changes may be made in the above methods, devices and structures without departing from the scope hereof. Many different arrangements of the various components depicted, as well as components not shown, are possible without departing from the spirit and scope of the present invention. Embodiments of the present invention have been described with the intent to be illustrative and exemplary of the invention, rather than restrictive or limiting of the scope thereof. Alternative embodiments will become apparent to those skilled in the art that do not depart from its scope. Specific structural and functional details disclosed herein are not to be interpreted as limiting, but merely as a representative basis for teaching one of skill in the art to employ the present invention in any appropriately detailed structure. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A method of using a training device having a left guide element and a right guide element to train a subject, the method comprising:

adjusting the training device for the subject; and receiving feedback from the training device during a movement performed by the subject, wherein the step of receiving feedback from the training device comprises determining a lateral aspect of a left knee or a right knee of the subject relative to the left guide element or the right guide element, respectively, during the movement, and wherein the step of adjusting the training device for the subject comprises attaching a lower end of the left guide element and a lower end of the right guide element to respective left and right feet of the subject.

2. The method of claim 1 wherein the step of adjusting the training device for the subject further comprises:

positioning the left guide element so that it extends from substantially at the subject's left shoulder to substantially at the subject's left toes; and positioning the right guide element so that it extends from substantially at the subject's right shoulder to substantially at the subject's right toes.

3. The method of claim 1 wherein the step of receiving feedback from the training device further comprises:

determining if a left knee or a right knee of the subject extended in front of the left guide element or the right guide element, respectively, during the movement.

4. The method of claim 1 wherein the movement is selected from the group consisting of a two-footed jump and a lateral bound.

5. The method of claim 1 further comprising the step of repeating the movement to reposition a left knee or a right knee with respect to the left guide element or right guide element, respectively.

6. The method of claim 1 further comprising the step of altering the movement in response to the feedback.

7. The method of claim 1 wherein the training device comprises:

a shoulder member for positioning the left and right guide elements in relation to the left and right shoulders of the subject, respectively; and left and right foot-attachment components for positioning respective left and right guide elements in relation to respective left and right feet of the subject.

8. The method of claim 7 wherein the step of adjusting the device further comprises adjusting the points of attachment of an upper end of the left guide element and an upper end of the right guide element to the shoulder member to position the upper ends thereof substantially at the subject's left and right shoulders, respectively.

9. The method of claim 8 wherein the step of attaching the lower end of the left guide element and the lower end of the right guide element to respective left and right feet of the subject comprises attaching the lower end of the left guide element and the lower end of the right guide element to respective left and right foot-attachment components to position the lower ends thereof substantially at the toes of the subject's left and right foot, respectively.

10. A method of using a training device having a left guide element and a right guide element to train a subject, the method comprising the steps of:

adjusting the training device for the subject; and receiving feedback from the training device during a movement performed by the subject, wherein the step of receiving feedback from the training device comprises determining a lateral aspect of a left knee or a right knee of the subject relative to the left guide element or the right guide element, respectively, during the movement, and wherein the left and right guide elements extend and contract during the movement to maintain a reference position running from the subject's left and right shoulders to the subject's left and right feet, respectively.

11. The method of claim 10 wherein the left and right guide elements exert a minimal force that does not substantially alter the subject's performance of the movement.

12. A training device comprising:

left and right guide elements, each guide element comprising an extendable band;

a shoulder member for positioning the left and right guide elements in relation to left and right shoulders of the subject, respectively;

a left foot-attachment component and a right foot-attachment component for positioning the left and right guide elements in relation to the left and right feet of the subject, respectively;

wherein the right and left guide elements extend from approximately the right and left shoulders of the user to approximately the right and left toes of the user, respectively.

13. The training device of claim 12, wherein the shoulder member is adjustable such that separation between left and right attachment points of the shoulder member is adjustable, wherein the left and right attachment points of the shoulder member are configured to facilitate the positioning of the left and right guide elements in relation to the left and right shoulders of the subject.

14. The training device of claim 13, wherein the adjustability of the shoulder member comprises adjustability of the length of the shoulder member.

15. The method of claim 10 wherein the step of adjusting the training device for the subject comprises:

positioning the left guide element so that it extends from substantially at the subject's left shoulder to substantially at the subject's left toes; and positioning the right guide element so that it extends from substantially at the subject's right shoulder to substantially at the subject's right toes.

16. The method of claim 10 wherein the step of receiving feedback from the training device further comprises:

determining if a left knee or a right knee of the subject extended in front of the left guide element or the right guide element, respectively, during the movement.

17. The method of claim 10 wherein the movement is selected from the group consisting of a two-footed jump and a lateral bound.

18. The method of claim 10 further comprising the step of repeating the movement to reposition a left knee or a right knee with respect to the left guide element or right guide element, respectively.

19. The method of claim 10 further comprising the step of altering the movement in response to the feedback.

20. The method of claim 10 wherein the training device comprises:

a shoulder member for positioning the left and right guide elements in relation to the left and right shoulders of the subject, respectively; and left and right foot-attachment components for positioning respective left and right guide elements in relation to respective left and right feet of the subject.

* * * * *